US005088435A

United States Patent [19]

Lathers

[11] Patent Number: 5,088,435

[45] Date of Patent: Feb. 18, 1992

[54] RECREATIONAL BOAT WITH IMPROVED COMPANIONWAY HATCH

[75] Inventor: Michael W. Lathers, Tustin, Mich.

[73] Assignee: Outboard Marine Corporation, Waukegan, Ill.

[21] Appl. No.: 413,106

[22] Filed: Sep. 27, 1989

[51] Int. Cl.[5] ..... B63B 19/00

[52] U.S. Cl. ..... 114/177; 160/201; 114/178

[58] Field of Search ..... 114/173-178, 114/201 R-203, 211; 160/201, 188; 49/385

[56] References Cited

U.S. PATENT DOCUMENTS

| | | | |
|---|---|---|---|
| 551,439 | 12/1895 | Hatcher | 49/385 |
| 859,049 | 7/1907 | Coston | 49/385 |
| 871,659 | 11/1907 | Abbott | 49/385 |
| 925,294 | 6/1009 | Chleboarad | 114/177 |
| 1,600,114 | 9/1926 | Johanson | 49/385 |
| 3,039,417 | 6/1962 | Hoffberg | 114/71 |
| 3,376,586 | 4/1968 | Forsyth et al. | 9/1 |
| 4,104,827 | 8/1978 | Opron et al. | 49/385 |
| 4,833,829 | 5/1989 | Wilson | 49/426 |

*Primary Examiner*—Ed Swinehart

*Attorney, Agent, or Firm*—Michael, Best & Friedrich

[57] ABSTRACT

A boat comprising a hull, a wall which is supported by the hull, which partially defines a space, and which has therein an opening affording access to the space, and a cover mounted on the wall for pivotal movement relative thereto about a pivot axis extending generally perpendicular to the wall, the cover being movable between an open position wherein the cover substantially uncovers the opening and a closed position wherein the cover substantially covers the opening.

25 Claims, 2 Drawing Sheets

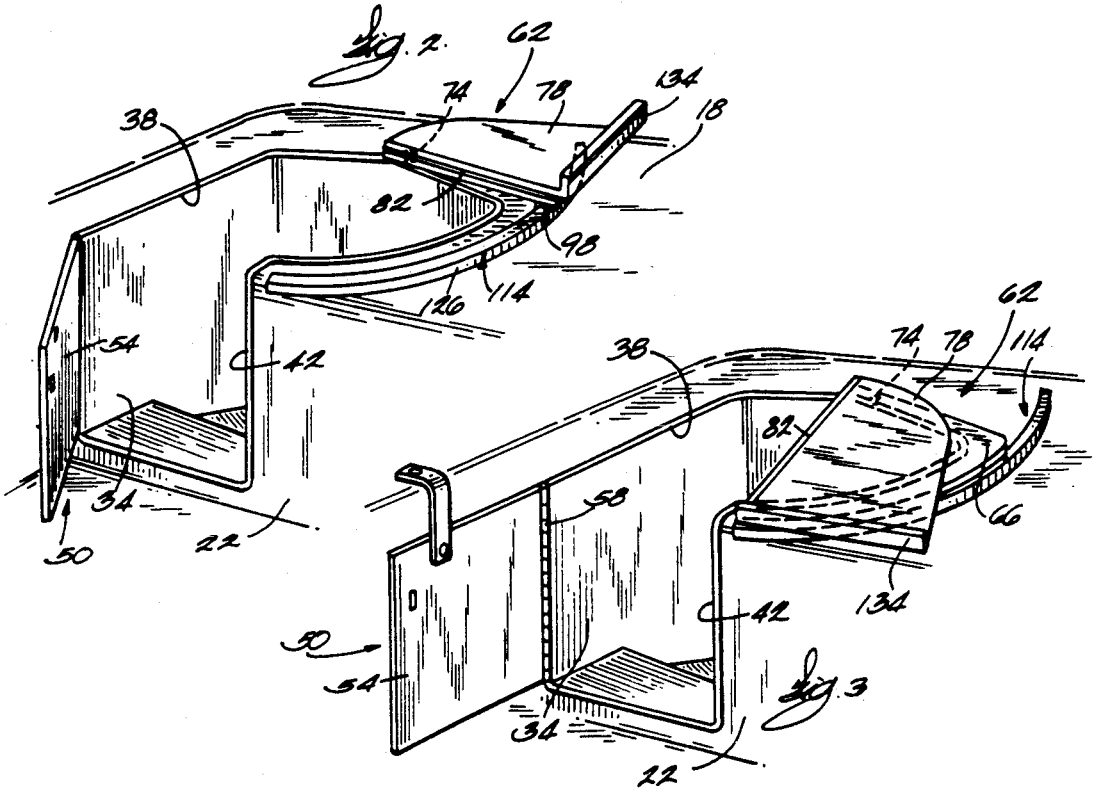
Fig. 2.
62
74
78
134
18
38
82
98
114
126
54
42
34
50
22
62
74
78
114
38
82
58
66
134
42
50
54
34
22
Fig. 3
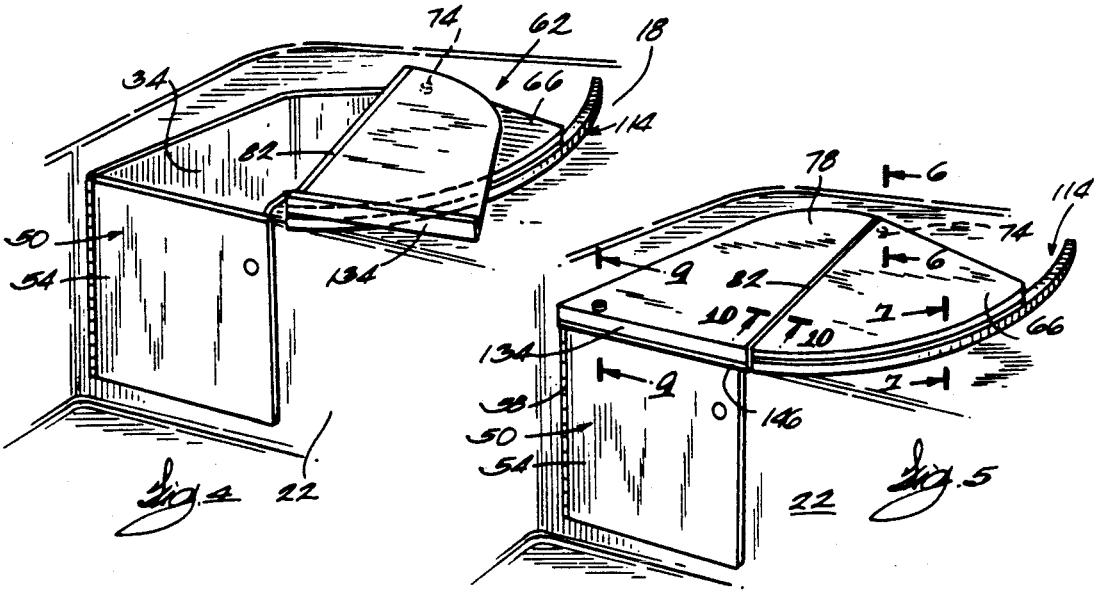
74
62
18
34
66
114
82
50
54
134
22
Fig. 4
78
6
114
74
6
9
82
10
7
10
7
66
134
9
7
38
146
50
54
22
Fig. 5

RECREATIONAL BOAT WITH IMPROVED COMPANIONWAY HATCH

BACKGROUND OF THE INVENTION

The invention relates to recreational boats and, more particularly, to hatches for such boats. Still more particularly, the invention relates to hatches for companionways or similar passageways.

A disadvantage of known companionway hatches is that they can obstruct the boat operator's vision when they are open. Another disadvantage of known companionway hatches is that they can bind and become difficult to operate due to thermal expansion and contraction.

SUMMARY OF THE INVENTION

The invention Provides a boat comprising a hull, a wall which is supported by the hull, which partially defines a space, and which has therein an opening affording access to the space, and a cover mounted on the wall for pivotal movement relative thereto about a pivot axis extending generally perpendicular to the wall, the cover being movable between an open position wherein the cover substantially uncovers the opening and a closed position wherein the cover substantially covers the opening.

The invention also provides a boat comprising a hull, a generally horizontal wall which is supported by the hull, which partially defines a space, and which has therein a first opening affording access to the space, a generally vertical wall which is supported by the hull, which intersects the horizontal wall and which has therein a second opening communicating with the first opening and affording access to the space, a cover including a first generally planar portion mounted on the horizontal wall for pivotal movement relative thereto about a generally vertical pivot axis and between an open position and a closed position, and a second generally planar portion mounted on the first portion for common pivotal movement therewith about the pivot axis and for pivotal movement relative thereto about a generally horizontal hinge axis, the second portion being movable relative to the first portion between a retracted position wherein the second portion lies on top of the first portion and an extended position wherein the second portion lies next to the first portion, the cover being operable between a first mode wherein the cover substantially covers the first opening when the first portion is in the closed position and the second portion is in the extended position, and a second mode wherein the cover substantially uncovers the first opening when the first portion is in the open position and the second portion is in the retracted position, and a door mounted on the vertical wall for movement relative thereto between an open position wherein the door substantially uncovers the second opening and a closed position wherein the door substantially covers the second opening.

The invention also provides a boat comprising a hull, a wall which is supported by the hull, which partially defines a space, and which has therein an opening affording access to the space, and cover means including a first cover portion movable relative to the wall between open and closed positions and in a plane extending generally parallel to the wall, and a second cover portion connected to the first cover portion for common movement with the first cover portion and for pivotal movement relative thereto between an extended position and a retracted position, the cover means being operable in a first mode wherein the first cover portion is in the closed position, wherein the second cover portion is in the extended position, and wherein the cover means substantially covers the opening, and being operable in a second mode wherein the first cover portion is in the open position, wherein the second cover portion is in the retracted position, and wherein the cover means substantially uncovers the opening.

The invention also provides an apparatus comprising a wall having therein an opening, a cover, and means for mounting the cover on the wall so that the cover is movable in a plane extending generally parallel to the wall, and is movable between an open position wherein the cover substantially covers the opening and a closed position wherein the cover substantially covers the opening, and for facilitating expansion and contraction of the cover.

The invention also provides a method for mounting a cover on a wall having therein an opening, the method comprising the steps of providing a first arcuate track centered on a pivot axis and a second arcuate track, fixing the first track to the cover, placing the second track in interengagement with the first track, placing the cover over the opening, connecting the cover to the wall so that the cover is pivotally movable relative to the wall about the pivot axis, and fixing the second track to the wall.

A principal feature of the invention is the provision of a companionway hatch that permits a person to remain standing while passing through the companionway.

Another principal feature of the invention is the provision of a companionway hatch that does not obstruct the operator's vision when the hatch is open.

Another principal feature of the invention is the provision of construction that substantially prevents binding of a companionway hatch due to thermal expansion and contraction of the hatch.

Other features and advantages of the invention will become apparent to those skilled in the art upon review of the following detailed description, claims, and drawings.

DESCRIPTION OF THE DRAWINGS

FIG. 2 is an enlarged, partial perspective view of the boat showing the door in its open position, the first cover portion in its open position and the second cover portion in its retracted position.

FIG. 3 is a view similar to FIG. 2 showing the door in its open position, the first cover portion in its closed position and the second cover portion in its retracted position.

FIG. 4 is a view similar to FIG. 2 showing the door in its closed position, the first cover portion in its closed position and the second cover portion in its retracted position.

FIG. 5 is a view similar to FIG. 2 showing the door in its closed position, the first cover portion in its closed position and the second cover portion in its extended position.

Figure 1:
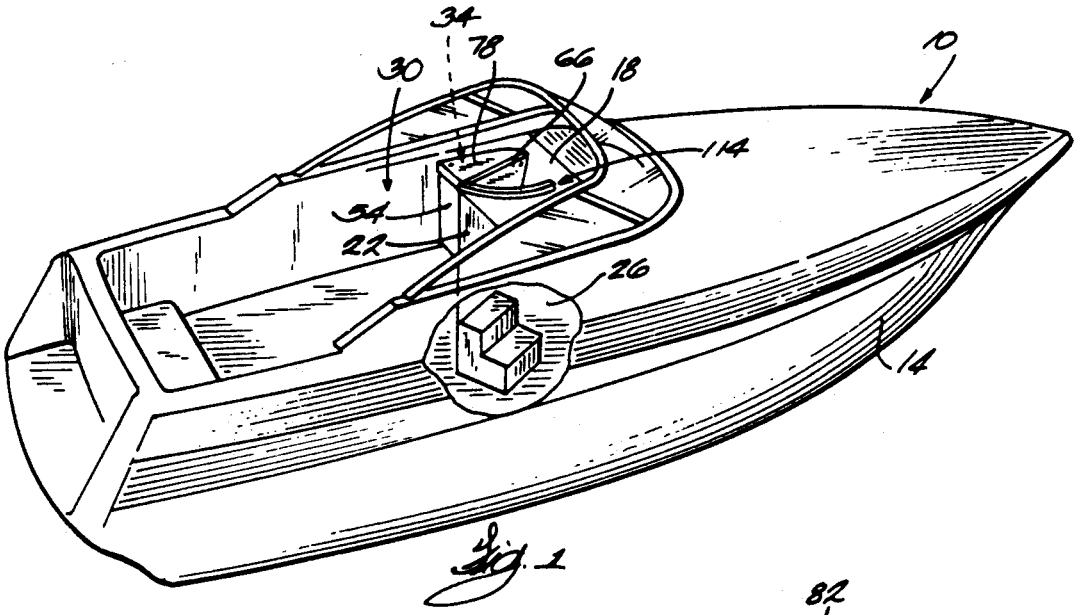
FIG. 1 is a perspective view of a boat embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A boat 10 embodying the invention is illustrated in the drawings. As shown in FIG. 1, the boat 10 comprises a hull 14, a generally horizontal wall or map deck 18 supported by the hull 14, and a generally vertical wall or cockpit bulkhead 22 supported by the hull 14. The cockpit bulkhead 22 and the map deck 18 intersect and Partially define a main cabin 26 located beneath the map deck 18.

The cockpit bulkhead 22 partially defines a cockpit 30, and the boat 10 also comprises (see FIGS. 1 and 2) a companionway 34 leading from the cockpit 30 to the main cabin 26. In the preferred embodiment, the companionway 34 is located in the map deck 18 and in the cockpit bulkhead 22 and is defined by a first opening 38 in the map deck 18 and by a second opening 42 in the cockpit bulkhead 22. Furthermore, in the preferred embodiment, the map deck 18 includes (see FIG. 7) a raised portion, ridge or lip 46 which surrounds the portion of the companionway 34 in the map deck 18 and which prevents water from flowing into the companionway 34.

The boat 10 also comprises (see FIGS. 2-5) lower cover means 50 operable in a first or closed mode (FIGS. 4 and 5) wherein the lower cover means 50 substantially covers the opening 42 and a second or open mode (FIG. 3) wherein the lower cover means 50 substantially uncovers the opening 42. While various suitable lower cover means 50 can be employed, in the preferred embodiment, such means includes a door 54 mounted on the cockpit bulkhead 22 for pivotal movement relative thereto about a generally vertical hinge axis 58 (FIG. 3). The door 54 is movable between a closed position (FIGS. 4 and 5) corresponding to the first mode of the lower cover means 50 and an open position (FIGS. 2-5) corresponding to the second mode of the lower cover means 50.

The boat 10 further comprises (see FIGS. 2-5) upper cover means 62 including a first generally planar cover portion 66 (see FIGS. 3-5) movable relative to the map deck 18 in a plane 70 (see FIG. 7) extending generally parallel to the map deck 18. Preferably, the first cover portion 66 pivots relative to the map deck 18 about a generally vertical pivot axis 74 (see FIGS. 2-6). The first cover portion 66 is movable between an open position (see FIG. 2) wherein the first cover portion 66 substantially uncovers the opening 38 and a closed position (see FIGS. 3-5) wherein the first cover portion 66 covers a portion of the opening 38. The upper cover means 62 also includes a second generally planar cover portion 78 (see FIGS. 2-5) connected to the first cover portion 66 for common pivotal movement therewith about the Pivot axis 74 and for pivotal movement relative thereto about a generally horizontal hinge axis 82. In the preferred embodiment, the hinge axis 82 substantially intersects but is slightly spaced from the pivot axis 74. The second cover portion 78 is movable relative to the first cover portion 66 between an extended position (see FIG. 5) wherein the second cover portion 78 lies next to and is generally coplanar with the first cover portion 66, and a retracted position (see FIGS. 2-4) wherein the second cover portion 78 lies on top of the first cover portion 66. When the first cover portion 66 is in its closed position and the second cover portion 78 is in its extended position, as shown in FIG. 5, the second cover portion 78 covers a second portion of the opening 38, so that the first and second cover portions 66 and 78 substantially cover the opening 38. The cover portions 66 and 78 are preferably made of Plexiglass.

The upper cover means 62 is operable in a first or closed mode (see FIG. 5) wherein the first cover portion 66 is in its closed position, wherein the second cover portion 78 is in its extended position, and wherein the upper cover means 62 substantially covers the opening 38. The upper cover means 62 is also operable in a second or open mode (see FIG. 2) wherein the first cover portion 66 is in its open position, wherein the second cover portion 78 is in its retracted position, and wherein the upper cover means 62 substantially uncovers the opening 38.

The upper cover means 62 also includes means for mounting the first cover portion 66 on the map deck 18 so that the first cover portion 66 is movable as described above between its open position and its closed position, and for facilitating expansion and contraction of the first cover portion 66. While various suitable mounting and facilitating means can be employed, in the preferred embodiment, such means includes means supporting the first cover portion 66 for pivotal movement relative to the map deck 18.

Figure 6:
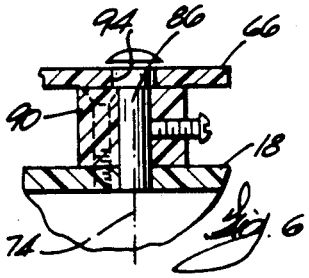
FIG. 6 is a view taken along line 6—6 in FIG. 5.
Figure 7:
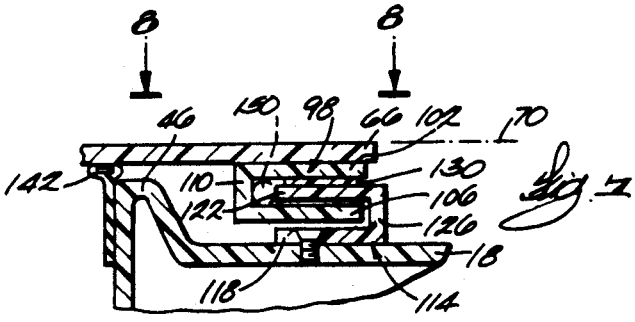
FIG. 7 is a view taken along line 7—7 in FIG. 5.
Figure 8:
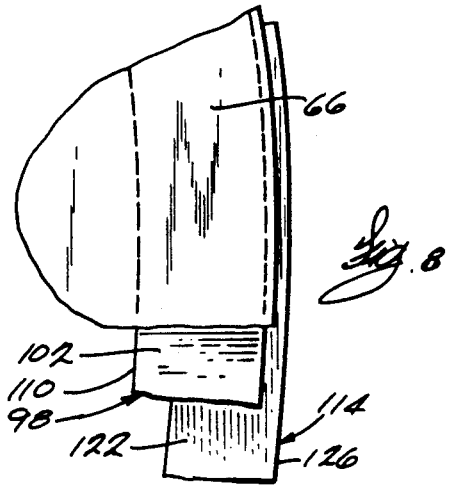
FIG. 8 is a view taken along line 8—8 in FIG. 7.

While various suitable supporting means can be used, in the illustrated construction, such means includes (see FIG. 6) a pivot pin 86 which is mounted on the map deck 18 and which extends along the pivot axis 74. As shown in FIG. 6, the pivot pin 86 is threaded into a cylindrical block 90 mounted on the map deck 18, and the upper end of the pivot pin 86 extends through an aperture 94 in the first cover portion 66 so that the first cover portion 66 pivots relative to the pivot pin 94. The means supporting the first cover Portion 66 for pivotal movement relative to the map deck 18 also includes (see FIGS. 5, 7 and 8) arcuate track means which is centered on and spaced from the pivot axis 74 and which guides movement of the first cover portion 66 relative to the map deck 18. The track means includes (see FIG. 7) a first arcuate track 98 mounted on the underside of the first cover portion 66 and centered on the pivot axis 74. The track 98 has a generally C-shaped cross section opening radially outwardly, i.e., away from the pivot axis 74. More particularly, the track 98 includes an upper portion 102 fixed to the underside of the first cover portion 66, a lower portion 106 extending generally parallel to and spaced from the upper portion 102, and a vertical portion 110 connecting the upper and lower portions 102 and 106. The upper and lower portions 102 and 106 extend radially outwardly from the vertical portion 110. The track means also includes (see FIG. 7) a second arcuate track 114 mounted on the map deck 18 and centered on the pivot axis 74. The track 114 has a generally C-shaped cross section, opens radially inwardly, and engages the track 98 on the first cover Portion 66. More particularly, the track 114 includes a lower portion 118 fixed to the map deck 18, an upper portion 122 generally parallel to and spaced from the lower portion 118, and a vertical portion 126 connecting the upper and lower portions 118 and 122. The upper and lower portions 118 and 122 extend radially inwardly from the vertical portion 126, and the upper portion 122 extends between the upper and lower portions 102 and 106 of the upper track 98. Similarly, the lower portion 106 of the upper track 98 extends between the upper and lower portions 118 and 122 of the lower track 114. Furthermore, as shown in FIG. 7, the upper portion 122 of the lower track 114 is spaced (preferably approximately one-quarter inch) from the vertical portion 110 of the upper track 98, and the lower portion 106 of the upper track 98 is spaced (preferably approximately one-quarter inch) from the vertical portion 126 of the lower track 114. This spacing permits radial thermal expansion and contraction of the first cover portion 66 while maintaining interengagement of the tracks 98 and 114. Such interengagement of the tracks 98 and 114 prevents upward movement of the first cover portion 66 relative to the map deck 18.

The track means further includes (see FIG. 7) an arcuate, low-friction slide member 130 located between a portion of the upper track 98 and a portion of the lower track 114, and preferably between the upper portion 102 of the upper track 98 and the upper portion 122 of the lower track 114. The slide member 130 transmits the weight of the first cover portion 66 from the upper track 98 to the lower track 114 and also facilitates relative sliding movement of the tracks 98 and 114.

Figure 9:
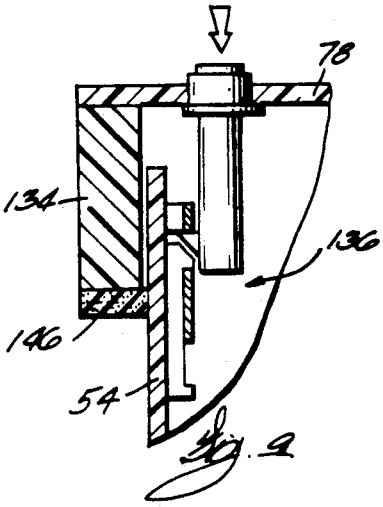
FIG. 9 is a view taken along line 9—9 in FIG. 5.

The boat 10 further comprises (see FIG. 9) means for preventing operation of the lower cover means 50 from its first mode to its second mode when the upper cover means 62 is in its first mode. Alternatively stated, the boat 10 comprises means for preventing opening of the door 54 when the upper cover means 62 is closed. While various suitable preventing means can be employed, in the preferred embodiment, such means includes a projection 134 which extends downwardly from the second cover portion 78 when the second cover portion 78 is in its extended position and which overlaps the upper end of the door 54 when the upper cover means 62 is in its first mode and the door 54 is closed. Preferably, the projection 134 is defined by a lip extending transversely from the rearward edge of the second cover portion 78.

The boat 10 further comprises (see FIG. 9) means for selectively locking the upper and lower cover means 50 and 62 in their first or closed modes. While various suitable locking means can be employed, in the preferred embodiment, such means includes means (not shown) for selectively locking the door 54 in its closed position, and means 136 for selectively securing the second cover portion 78 to the door 54 when the door 54 is in its closed position, the first cover portion 66 is in its closed position and the second cover portion 78 is in its extended position. Preferably, the locking means is manually operable, without a key, from the inside and can be locked from the inside so that a key is necessary to open the locking means from the outside.

Figure 10:
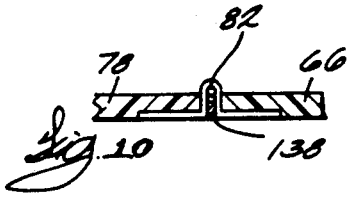
FIG. 10 is a view taken along line 10—10 in FIG. 5.

The boat 10 further comprises means for sealing the joints between the first and second cover portions 66 and 78, between the upper cover means 62 and the map deck 18, between the door 54 and the cockpit bulkhead 22, and between the second cover portion 78 and the door 54. Preferably, the sealing means includes a suitable sealing member 138 (see FIG. 10) connected to the inside edge of either of the first and second cover portions 66 and 78, a suitable seal, such as a bulb seal 142 (see FIG. 7), extending around the periphery of the companionway 34, and a suitable seal 146 (see FIG. 9) mounted either on the door 54 or on the lip 134 so as to seal the joint between the door 54 and the lip 134.

The upper cover means 62 and the track means are preferably mounted on the map deck 18 as follows. First, the upper track 98 is fixed to the underside of the first cover portion 66, and the lower track 114 is placed in interengagement with the upper track 98. In order to maintain the proper spacing between the vertical portion 110 of the upper track 98 and the upper portion 122 of the lower track 114 and between the vertical portion 126 of the lower track 114 and the lower portion 106 of the upper track 98, a suitable spacer, such as a flexible tube 150 (shown in phantom in FIG. 7), is located either between the vertical Portion 110 of the upper track 98 and the upper Portion 122 of the lower track 114 or between the vertical portion 122 of the lower track 114 and the lower portion 106 of the upper track 98. The tube or spacer 150 preferably has a width or diameter of approximately one-quarter inch so as to maintain the desired spacing between the tracks 98 and 114. Next, the first cover portion 66 is placed in its closed position and the pivot axis 74 is established on the map deck 18 by locating the block 90 on the map deck 18. Next, the lower track 114 is fixed to the map deck 18. Proper positioning of the lower track 114 is substantially assured because the pivot axis 74 has been set and the lower track 114 is located in proper relation to the upper track 98. Finally, the spacer 150 is removed from between the tracks 98 and 114.

The upper and lower cover means 50 and 62 operate as follows. When the first cover portion 66 is in its open position, the second cover portion 78 is in its retracted position and the door 54 is in its open position, as shown in FIG. 2, the companionway 34 is substantially uncovered. In order to close the companionway 34, the door 54 is moved to its closed position (see FIG. 4), the first cover portion 66 is moved to its closed position (see FIG. 4), and the second cover portion 78 is moved to its extended position (see FIG. 5).

Various features of the invention are set forth in the following claims.

I claim:

1. A method for mounting a cover on a wall having therein an opening, said method comprising the steps of providing a first arcuate rack forming a portion of a circle centered on a pivot axis, providing a second arcuate track, fixing said first track to said cover, placing said second track in interengagement with said first track, connecting said cover to said wall so that said cover is pivotally movable relative to said wall about said pivot axis, and fixing said second track to said wall, one of said track providing steps including providing one of said first and second tracks with generally parallel, planar portions spaced apart in the direction of said axis, and a third portion connecting said first and second portions and extending in the direction of said axis, and the other of said track providing steps including providing the other of said first and second tracks with a portion extending between said parallel portions for arcuate movement relative thereto, and wherein said method further comprises the step of inserting a spacer between said third portion and said portion of said other of said first and second tracks prior to fixing said second track to said wall.

2. A method as set forth in claim 1 and further comprising the step of removing said spacer after fixing said second track to said wall.

3. A boat comprising a hull, a wall which is supported by said hull, which partially defines a space, and which has therein an opening affording access to said space, and a cover mounted on said wall for pivotal movement relative thereto about a pivot axis extending generally perpendicular to said wall, said cover being movable between an opening position wherein said cover substantially uncovers said opening and a closed position wherein said cover substantially covers said opening, and said cover including a first generally planar portion mounted on said wall for pivotal movement relative thereto about said pivot axis, and a second generally planar portion mounted on said first portion for common pivotal movement therewith about said pivot axis and for pivotal movement relative thereto about a hinge axis extending generally parallel to said wall.

4. A boat as set forth in claim 3 wherein said second portion is movable relative to said first portion between a retracted position wherein said second portion lies on top of said first portion and an extended position wherein said second portion lies next to said first portion.

5. A boat as set forth in claim 3 wherein said hinge axis generally intersects said pivot axis.

6. A boat as set forth in claim 3 and further comprising means supporting said first cover portion for pivotal movement relative to said wall.

7. A boat as set forth in claim 6 wherein said supporting means includes an arcuate track mounted on said wall and centered on said pivot axis.

8. A boat comprising a hull, a wall which is supported by said hull, which partially defines a space, which has therein an opening affording access to said space, and which extends generally horizontally, a cover mounted on said wall for pivotal movement relative thereto about a pivot axis extending generally perpendicular to said wall, said cover being movable between an open position wherein said cover substantially uncovers said opening and a closed position wherein said cover substantially covers said opening, a generally vertical wall which is supported by said hull, which intersects said horizontal wall and which has therein a second opening communicating with said opening in said horizontal wall, and a door mounted on said vertical wall for movement between an open position wherein said door does not cover said second opening and a closed position wherein said door covers said second opening.

9. A boat comprising a hull, a wall which is supported by said hull, which partially defines a space, which has therein an opening affording access to said space, and which extends generally horizontally and includes a ridge surrounding said opening so as to prevent water from flowing into said opening, and a cover mounted on said wall for pivotal movement relative thereto about a pivot axis extending generally perpendicular to said wall, said cover being movable between an open position wherein said cover substantially uncovers said opening and a closed position wherein said cover substantially covers said opening.

10. A boat comprising a hull, a generally horizontal wall which is supported by said hull, which partially defines a space, and which has therein a first opening affording access to said space, a generally vertical wall which is supported by said hull, which intersects said horizontal wall and which has therein a second opening communicating with said first opening and affording access to said space, a cover including a first generally planar Portion mounted on said horizontal wall for pivotal movement relative thereto about a generally vertical pivot axis and between an open position and a closed position, and a second generally planar portion mounted on said first portion for common pivotal movement therewith about said pivot axis and for pivotal movement relative thereto about a generally horizontal hinge axis, said second portion being movable relative to said first portion between a retracted position wherein said second portion lies on top of said first portion and an extended position wherein said second portion lies next to said first portion, said cover being operable between a first mode wherein said cover substantially covers said first opening when said first Portion is in said closed position and said second portion is in said extended position, and a second mode wherein said cover substantially uncovers said first opening when said first portion is in said open position and said second portion is in said retracted position, and a door mounted on said vertical wall for movement relative thereto between an open position wherein said door substantially uncovers said second opening and a closed position wherein said door substantially covers said second opening.

11. A boat as set forth in claim 10 wherein said hinge axis generally intersects said pivot axis.

12. A boat as set forth in claim 10 and further comprising means supporting said first cover portion for pivotal movement relative to said horizontal wall.

13. A boat as set forth in claim 12 wherein said supporting means includes an arcuate track mounted on said horizontal wall and centered on said pivot axis.

14. A boat as set forth in claim 10 wherein said horizontal wall includes a ridge surrounding said first opening so as to prevent water from flowing into said first opening.

15. A boat comprising a hull, a wall which is supported by said hull, which partially defines a space, and which has therein an opening affording access to said space, and cover means including a first cover portion movable relative to said wall between open and closed positions and in a plane extending generally parallel to said wall, and a second cover portion connected to said first cover portion for common movement with said first cover portion and for pivotal movement relative thereto between an extended position and a retracted position, said cover means being operable in a first mode wherein said first cover portion is in said closed position, wherein said second cover portion is in said extended position, and wherein said cover means substantially covers said opening, and being operable in a second mode wherein said first cover portion is in said open position, wherein said second cover portion is in said retracted position, and wherein said cover means substantially uncovers said opening.

16. A boat as set forth in claim 15 wherein said first cover portion pivots relative to said wall about a pivot axis extending generally perpendicular to said plane.

17. A boat as set forth in claim 15 wherein said second cover portion pivots relative to said first cover portion about a hinge axis extending generally parallel to said plane.

18. A boat as set forth in claim 17 wherein said first cover portion pivots relative to said wall about a pivot axis extending generally perpendicular to said plane and generally intersecting said hinge axis.

19. A boat as set forth in claim 15 and further comprising a second wall which is supported by said hull, which intersects said first-mentioned wall, and which has therein a second opening communicating with said first-mentioned opening in said first-mentioned wall, and second cover means operable in a first mode wherein said second cover means substantially covers said second opening and a second mode wherein said second cover means substantially uncovers said second opening.

20. A boat as set forth in claim 19 and further comprising means for preventing operation of said second cover means from said first mode to said second mode when said first cover means is in said first mode.

21. A boat as set forth in claim 20 wherein said second cover means includes a door mounted on said second wall for pivotal movement relative thereto about an axis extending generally perpendicular to said Plane, wherein said second cover portion extends generally parallel to said plane wherein said second cover portion is in said extended position, and wherein said second cover portion has thereon a projection overlapping said door when said second cover portion is in said extended position, said first cover portion is in said closed position, and said door is in said first mode.

22. A boat as set forth in claim 15 wherein said wall extends generally horizontally and includes a ridge surrounding said opening so as to prevent water from flowing into said opening.

23. Apparatus comprising a wall having therein an opening, a cover having a first portion and a second portion hinged to said first portion for movement between a first position in generally coplanar relation to said first portion and a second position in generally parallel overlying relation to said first portion, and means for mounting said first portion of said cover on said wall so that said cover is pivotally movable in a plane extending generally parallel to said wall, about a pivot axis extending generally perpendicular to said plane, and between an open position wherein said first portion of said cover is substantially clear of said opening and said second portion of said cover is in said second position and a closed position wherein said second portion of said cover is in said first position and said cover substantially covers said opening, said mounting means including a first arcuate track mounted on said wall and forming a portion of a circle centered on said pivot axis, and a second arcuate track which is mounted on said first portion of said cover, which forms a portion of a circle centered on said pivot axis, and which engages said first arcuate track.

24. Apparatus comprising a wall having therein an opening, a cover, and means for facilitating expansion and contraction of said cover and for mounting said cover on said wall so that said cover is pivotally movable in a plane extending generally parallel to said wall, about a pivot axis extending generally perpendicular to said plane, and between an open position wherein said cover substantially uncovers said opening and a closed position wherein said cover substantially covers said opening, said mounting means including a first arcuate track mounted on said wall and forming a portion of a circle centered on said pivot axis, and a second arcuate track which is mounted on said cover, which forms a portion of a circle centered on said pivot axis, and which engages said first arcuate track, one of said first and second tracks including generally parallel, planar portions spaced apart in the direction of said axis, and the other of said first and second tracks including a portion extending between said parallel portions for arcuate movement relative thereto.

25. Apparatus as set forth in claim 24 wherein one of said tracks has a generally C-shaped cross section opening radially inwardly, and wherein the other of said tracks has a generally C-shaped cross section opening radially outwardly.

* * * * *